US009561481B2

(12) United States Patent
Schlueter et al.

(10) Patent No.: US 9,561,481 B2
(45) Date of Patent: Feb. 7, 2017

(54) MULTI-CHEMICAL DISPENSING DEVICE

(71) Applicant: Dema Engineering Company, St. Louis, MO (US)

(72) Inventors: James Michael Schlueter, O'fallon, MO (US); Paul Edward Naslund, Raleigh, NC (US)

(73) Assignee: Dema Engineering Company, St. Louis, MO (US)

( * ) Notice: Subject to any disclaimer, the term of this patent is extended or adjusted under 35 U.S.C. 154(b) by 390 days.

(21) Appl. No.: 14/319,946

(22) Filed: Jun. 30, 2014

(65) Prior Publication Data

US 2015/0375183 A1 Dec. 31, 2015

(51) Int. Cl.

| | |
|---|---|
| ***B01F 5/06*** | (2006.01) |
| ***B01F 5/04*** | (2006.01) |
| ***B01F 15/04*** | (2006.01) |
| ***B01F 3/08*** | (2006.01) |

(52) U.S. Cl.

CPC ..... *B01F 5/042* (2013.01); *B01F 3/0865* (2013.01); *B01F 5/043* (2013.01); *B01F 15/0429* (2013.01); *B01F 2003/0896* (2013.01)

(58) Field of Classification Search

CPC ..... B01F 5/0682

USPC .. 366/177.1, 182.4, 160.1, 160.2; 137/625.4, 625.41

See application file for complete search history.

(56) References Cited

U.S. PATENT DOCUMENTS 773,541 A * 11/1904 Bunting ..... G05D 23/1346 137/606

5,971,604 A * 10/1999 Linga ..... B01F 15/0429 137/625.3

6,454,457 B1 * 9/2002 Banse ..... B01F 5/205 366/136

* cited by examiner

*Primary Examiner* — David Sorkin

(74) *Attorney, Agent, or Firm* — Husch Blackwell LLP

(57) ABSTRACT

A multi-chemical dispensing device comprising a concentrate supply of at least one chemical concentrate, a flow selector valve in fluid communication with said concentrate supply, and at least two proportioners, each proportioner in fluid communication with the flow selector valve. The flow selector valve may include a dilution member comprising one or more aligned orifice pairs, each orifice pair including an first orifice and a second orifice in fluid communication with the concentrate supply. Each orifice has an opening area to provide a known dilution ratio at a known flow rate therethrough. Each proportioner is connected to a supply of motive fluid. The concentrate dispensing device includes a plurality of check valves that close off the system when one of the water supplies is turned on. The plurality of check valves are also configured to allow the chemical concentrate to drain out of the multi-chemical dispensing device using gravity.

18 Claims, 6 Drawing Sheets

MULTI-CHEMICAL DISPENSING DEVICE

CROSS-REFERENCE TO RELATED APPLICATIONS

None.

BACKGROUND OF THE INVENTION

Field of the Invention

The present invention is in the field of chemical dispensing and mixing devices used to mix and dilute bulk chemicals into usable product portions.

Description of Related Art

Existing chemical dispensing devices using proportioners are known in the art. The current chemical dispensing devices do not allow a user to (1) dispense multiple chemicals from the same dispensing device, (2) select from different dilution ratios, and (3) select from different fill rates. Having one chemical dispensing device that is operable to provide such functionality has been a long-felt, but unresolved need in the art.

Thus, there is a need in the art for a chemical dispenser that can dispense multiple chemicals and is operable to dispense the chosen chemical concentrate to be mixed with water to achieve one of multiple dilution rates. In addition, the chemical dispenser may be able to dispense the chemical concentrate such that the desired dilution rate can be achieved at different known water flow rates through different proportioners.

SUMMARY OF THE INVENTION

The present application is directed toward a chemical dispensing device that comprises a chemical supply, a flow selector valve, and at least two proportioners for mixing a chemical concentrate and water to a desired dilution rate. The flow selector valve may be in fluid communication with the chemical supply. The flow selector valve may include a housing that defines a fluid chamber having a selector valve insert that is rotatably mounted therein. The housing may include a concentrate intake port and at least one concentrate outflow port. The concentrate intake port may be in fluid communication with the chemical supply. The valve insert may include a flow chamber defined partially by a dilution member and flow chamber may be in fluid communication with the chemical supply. The dilution member may include one or more orifice sets, each orifice set may comprise one first orifice and one second orifice. Each orifice set may be radially aligned relative to a member center and each of the first orifice and the second orifice may have an opening area allowing a fluid flow therethrough to provide a known dilution ratio when mixed with water at a known water flow rate.

A first check valve is in fluid communication with the flow chamber. The first check valve may be biased in an open position and operable to close upon a suction force acting within said chemical dispensing device. This first check valve is used to allow chemical to drain.

The chemical dispensing device may also include a first proportioner that is in fluid communication with a first orifice in the flow selector valve and in fluid communication with a first water supply that supplies water to the first proportioner at a known first water flow rate. The chemical dispensing device may include a second proportioner in fluid communication with a second orifice in the flow selector valve and in fluid communication with a second water supply to provide water to the second proportioner at a known second water flow rate. A second check valve may be operably disposed between the flow selector valve and the first proportioner, wherein the second check valve is biased closed in a first direction opposite of fluid flow from said flow selector valve to said first proportioner. A third check valve may be operably disposed between the flow selector valve and the second proportioner, wherein the third check valve is biased closed in a second direction opposite of fluid flow from said flow selector valve to said second proportioner. When the water supply to a proportioner is turned on, the flow of water through the proportioner creates a suction force that draws the chemical concentrate into the proportioner. Both the second and third check valves are operable to open upon a suction force that acts in the direction of the first and second directions of fluid flow respectively. When the suction force is no longer present after turning off the water supply to one of the proportioners, the open check valves close and the atmospheric air pressure allows any chemical concentrate remaining in the chemical dispensing device to drain back into the bulk container.

Thus, the combination of elements allows a user operating the present chemical dispensing device to at least (1) dispense multiple chemicals from one device, (2) at multiple dispensing rates, and (3) with multiple independent dilution ratios desired by the user.

Other aspects and advantages of the present invention will be apparent from the following detailed description of the preferred embodiments and the accompanying drawing figures.

BRIEF DESCRIPTION OF THE SEVERAL VIEWS OF THE DRAWING

The accompanying drawings form a part of the specification and are to be read in conjunction therewith, in which like reference numerals are employed to indicate like or similar parts in the various views.

DETAILED DESCRIPTION OF THE INVENTION

The following detailed description of the present invention references the accompanying drawing figures that illustrate specific embodiments in which the invention can be practiced. The embodiments are intended to describe aspects of the present invention in sufficient detail to enable those skilled in the art to practice the invention. Other embodiments can be utilized and changes can be made without departing from the spirit and scope of the present invention. The present invention is defined by the appended claims and, therefore, the description is not to be taken in a limiting sense and shall not limit the scope of equivalents to which such claims are entitled.

Figure 1:
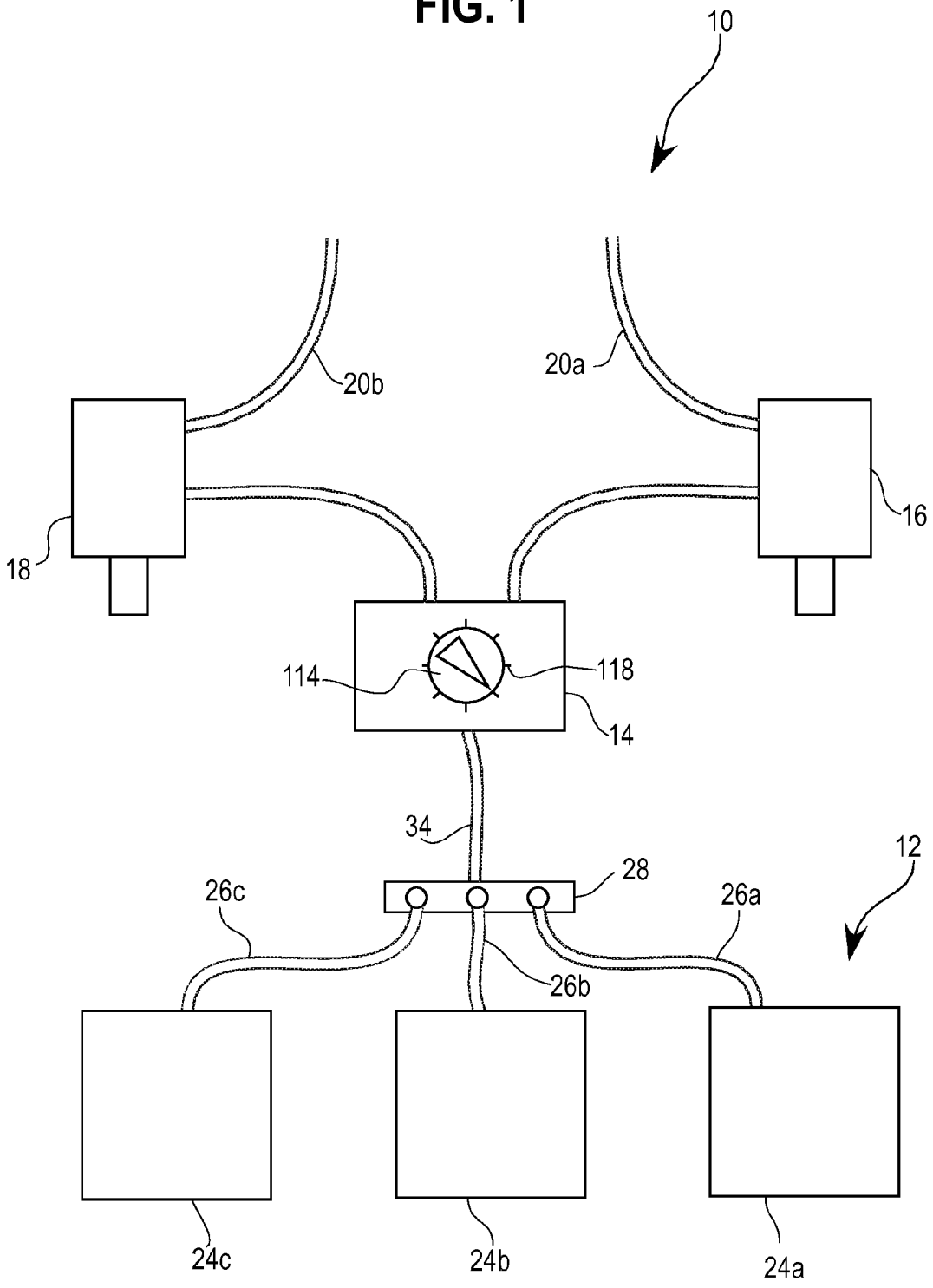
FIG. 1 is a schematic view of one embodiment of a chemical dispensing device in accordance with the teachings of the present invention.

FIG. 1 illustrates one embodiment of a chemical dispensing device 10 that is in fluid connection with a bulk chemical supply 12, wherein the chemical dispensing device 10 includes a flow selector valve 14, a first proportioner 16 in fluid communication with flow selector valve 14, and a second proportioner 18 in fluid communication with flow selector valve 14. First proportioner 16 and second proportioner 18 are each connected to a water supply via a water supply tube 20*a* and 20*b*. Water may be supplied at a first water flow rate to one proportioner and a second water flow rate to another proportioner. Alternatively, water supply may provide both proportioners with the same water flow rate.

Figure 2:
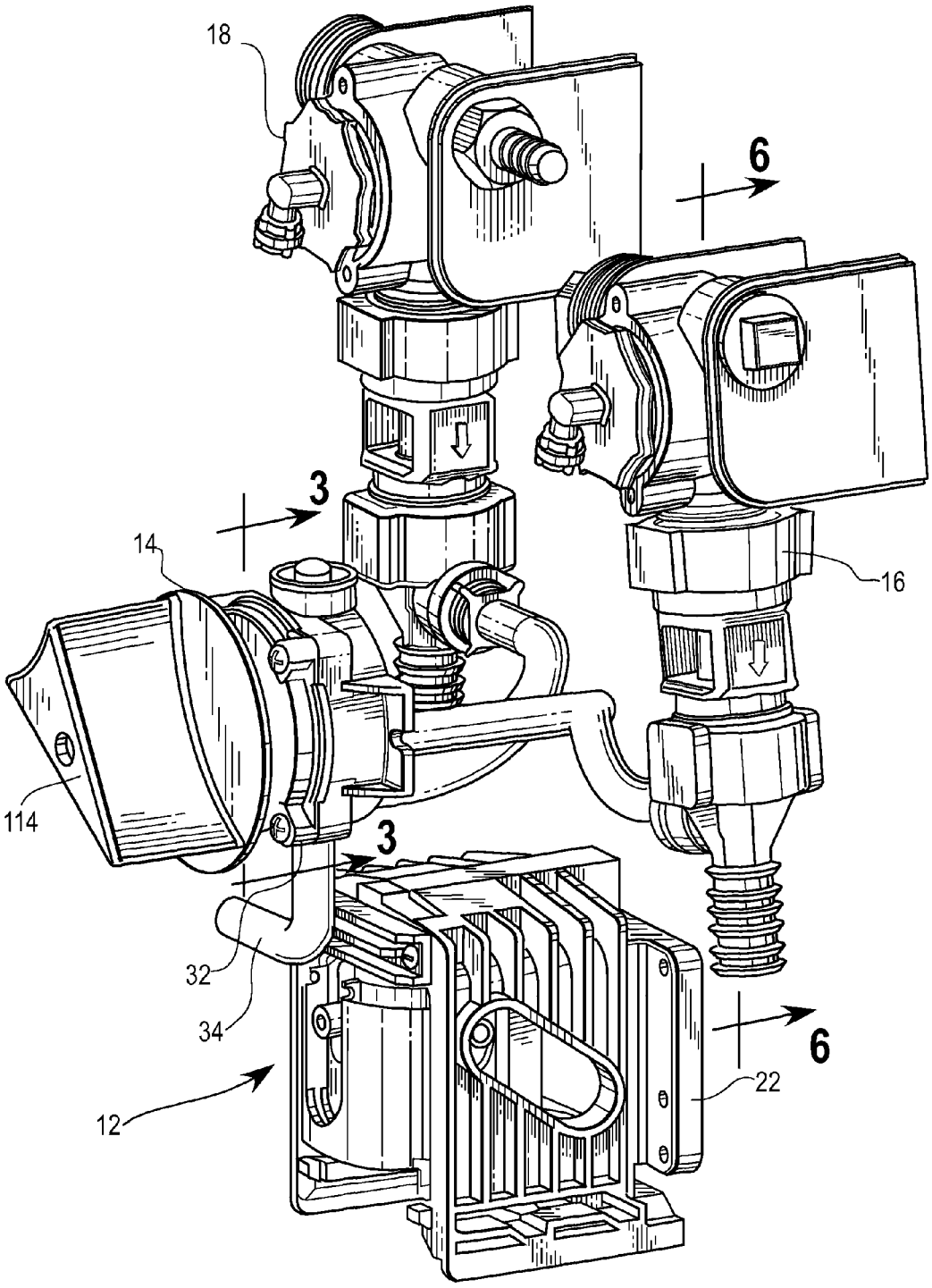
FIG. 2 is a side perspective view of another embodiment of a chemical dispensing device in accordance with the teachings of the present invention.

As shown in FIGS. 1 and 2, bulk chemical supply 12 may comprise a dock 22 and a plurality of bulk containers 24. Dock 22 may include two or more bulk containers 24 (not shown in FIG. 2) being in fluid communication therewith wherein a user has the ability to use dock 22 to select from which bulk container 24 to the chemical concentrate will be drawn. Bulk containers 24 may utilize an inter-locking docking connection to dock 22 wherein the bulk container 24 is in fluid communication with dock 22.

Alternatively, bulk containers 24 may include a plurality of concentrate supply tubes (not shown) that place the contents of bulk containers 24 in fluid communication with dock 22. As shown in FIG. 1, bulk chemical supply 12 may comprise a plurality of bulk containers 24*a*, 24*b*, and 24*c* and a plurality of bulk supply tubes 26*a*, 26*b*, and 26*c* that places the contents of the respective bulk containers 24*a*, 24*b*, and 24*c* in fluid communication with a chemical selection manifold 28. A user may use a chemical selection manifold to select the bulk container 24*a*, 24*b*, or 24*c* from which the concentrated chemical concentrate is to be drawn.

Bulk containers 24 may include a bulk volume of a concentrated liquid chemical concentrate that is intended for use in a number of applications including kitchen and food service, housekeeping, laundry, food and beverage preparation, industrial, and agricultural applications. Bulk containers 24 may be of any volume known in the art.

Figure 3:
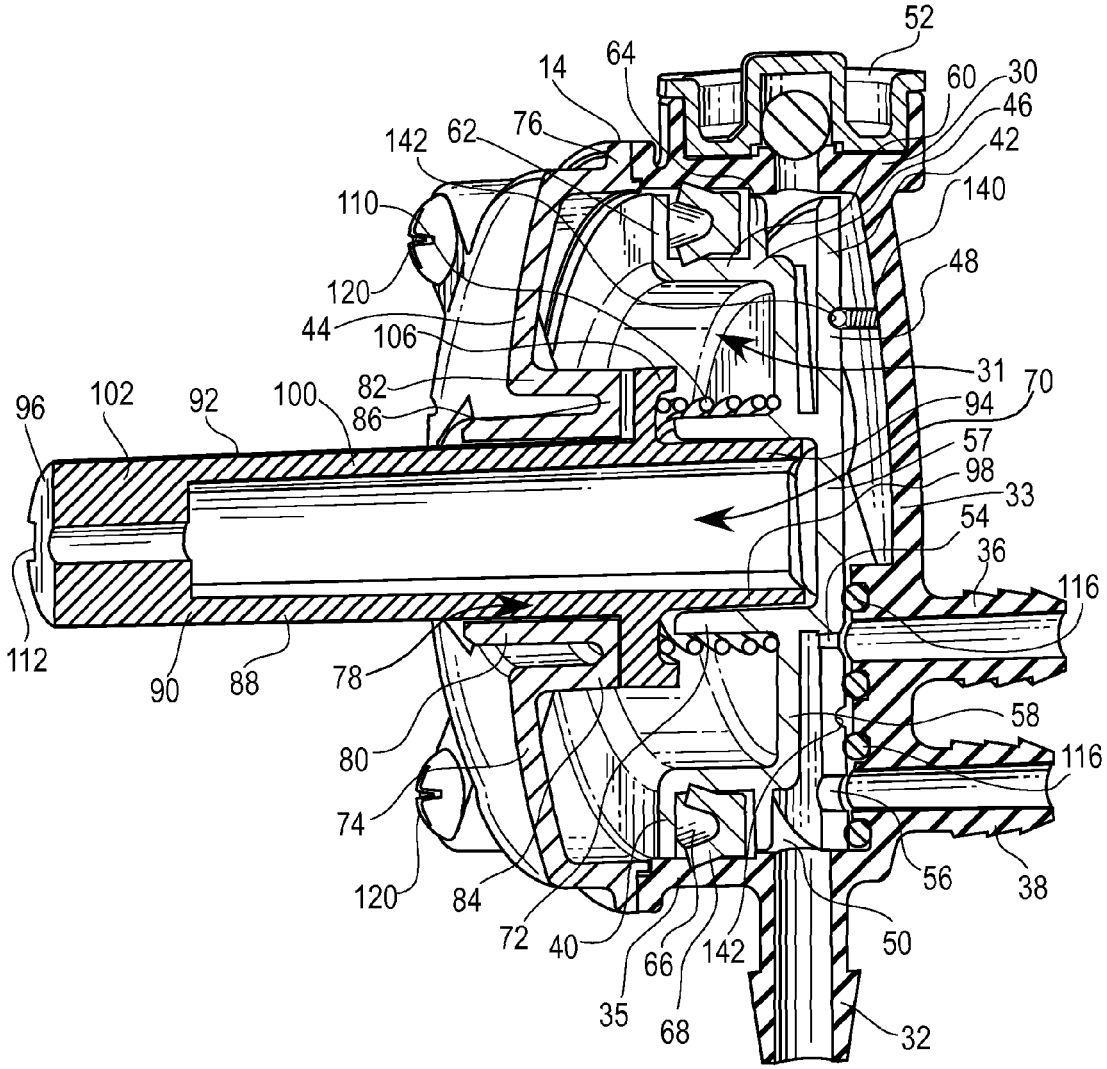
FIG. 3 is a cross-sectional view of the flow selector valve of the embodiment the chemical dispensing device of FIG. 2 along the line 3-3.

As shown in FIG. 3, the flow selector valve 14 includes a housing 30 defining a fluid chamber 31. Housing 30 comprises an end plate 33 and a tubular sidewall 35 extending away from end plate 33. Housing 30 also includes a concentrate intake port 32 in fluid communication with fluid chamber 31. As shown in FIGS. 1 and 2, a concentrate supply tube 34 is connected to both concentrate intake port 32 and bulk chemical supply 12 and provides a chemical passageway that places chemical flow selector valve 14 in fluid communication with bulk chemical supply 12. Particularly, as shown in FIG. 1, concentrate supply tube 34 connects manifold 28 to flow selector valve 14 to provide a passageway for a selected chemical concentrate to flow from bulk container 24 to flow selector valve 14. Similarly, as shown in FIG. 2, concentrate supply tube 34 connects dock 22 to flow selector valve 14 thereby providing a passageway for a selected chemical concentrate to flow from bulk container 24 to flow selector valve 14.

Now turning back to FIG. 3, housing 30 also includes a first concentrate outflow port 36 and a second concentrate outflow port 38. The first and second concentrate outflow ports 36 and 38 are in fluid communication with fluid chamber 31.

FIG. 3 shows that flow selector valve 14 also includes a selector valve insert 40 which is rotatably mounted within a fluid chamber 31. The embodiment of valve insert 40 shown in FIG. 3 includes an inner portion 42 and an outer portion 44. However, valve insert 40 may be a singlely cast or molded element, or combination of elements having substantially similar elements, properties, and functionalities as those described below. Inner portion 42 includes an outer plate 46 and a flat plate dilution member 48 separated by a gap. The gap is a fluid flow chamber 50 that is defined by outer plate 46 and dilution member 48. Fluid flow chamber 50 is within fluid chamber 31 and is in fluid communication with concentrate intake port 36 as shown. Fluid flow chamber 50 is also in fluid communication with a first check valve 52. First check valve 52 is biased to a normally open position such that when fluid is not actively flowing through the flow selector valve 14 the first check valve 52 is open, and the chemicals can then drain back from flow selector valve 14 into their respective bulk containers 24 through concentrate supply tube 34. However, as fluid is drawn by vacuum through the system, the resulting vacuum created closes first check valve 52.

Figure 4:
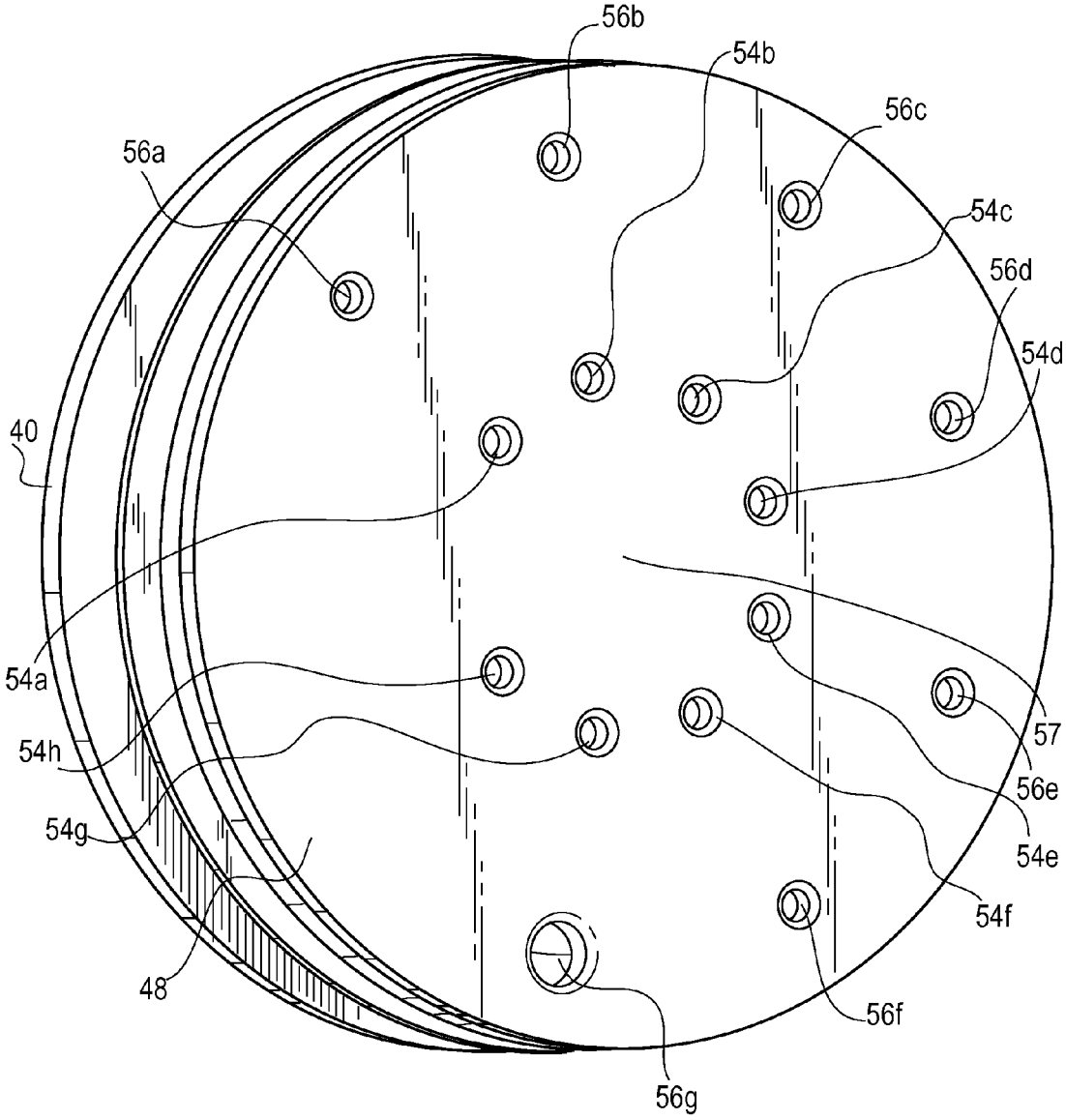
FIG. 4 is a perspective view of one embodiment of a dilution member of a valve insert an embodiment of a chemical dispensing device in accordance with the teachings of the present invention.

As further shown in FIG. 3, dilution member 48 of inner portion 42 includes a plurality of first orifices 54 and a plurality of second orifices 56 disposed through dilution member 48. First orifices 54 and second orifices 56 are in fluid communication with fluid flow chamber 50 and are radially positioned such that first orifices 54 are radially positioned on dilution member 48 to align with first chemical outlet port 36 and second orifices 56 are radially positioned on dilution member 48 to align with second outlet port 38 as shown. As shown in FIG. 4, one embodiment of selector valve insert 40 is shown with dilution member 48 including first orifices 54*a-h* and second orifices 56*a-g*. As can be seen, first orifices 54*a-g* and second orifices 56*a-g* are radially aligned from a center 57 of dilution member 48. Now turning to FIG. 3, the radial alignment of first orifices 54 and second orifices 56 positions orifices 54 and 56 such that they are centered on the outlet ports 36 and 38 respectively. However, a person of skill in the art would appreciate that the orifices 54 and 56 may be alternatively arranged on the dilution member 48 with a different spatial regularity to match the location of outlet ports 36 and 38 to provide the identical functionality in a different arrangement. Housing 30 may also include a detent 140 disposed on housing 30 to engage one of a plurality of indentions 142 in dilution member 48 to correctly position it with respect to outlet ports 36 and 38. O-rings 116 may be positioned between back plate 33 of flow selector valve housing 30 and dilution member 48 to surround and seal off the passage between outlet ports 36 and 38 and orifices 54 and 56.

As further shown in FIG. 4, orifices 54 and 56 may be of differing sizes, having different opening areas to provide different chemical concentration and dilution ratios. The opening area of the orifice corresponds to the volume of chemical which can flow through the orifice and, therefore, when combined with the known motive fluid flow rate determines the resulting dilution ratio.

In addition, in one embodiment shown in FIG. 4, first orifices 54 may be smaller to mix the chemical at a low water flow rate and second orifices 56 are relatively larger than first orifices 54 to provide a dilution ratio for a high water flow rate. Therefore, an orifice pair comprising one first orifice 54 and one second orifice 56 in radial alignment can be sized to provide the same dilution rate, one orifice sized to provide the dilution rate at a low water flow mixing rate and one orifice sized to provide the dilution rate at a high water flow mixing rate. Another embodiment not shown could include each orifice pair of radially aligned first orifice 54 and second orifice 56 being sized the same, and having a known flow rate difference such that each radial position produces one dilution rate through orifice 54 and another dilution rate through orifice 56. For example, given a high water flow rate and a low water flow rate, then if the orifice 56 and orifice 54 were the same size, the dilution ratio of the water/chemical mixture flowing through an orifice leading to the high water flow rate proportioner 18 would be less than that of the first proportioner 16. The orifices may be sized to provide a known difference.

Turning back to FIG. 3, outer plate 46 of inner portion 42 further includes a recessed center plate 58 and an outwardly extending annular outer wall 60 substantially perpendicular to the recessed center plate 58. Outer wall 60 includes an annular flange 62 extending outward from outer wall 60 and an annular ring leg 64 extending outward from outer wall 60 and offset a distance from flange 62 toward recessed center plate 58. The space between flange 62 and ring leg 64 forms a seal housing 66 which receives an annular ring seal 68 to close off fluid chamber 31. Inner portion 42 of valve insert 40 further comprises a handle socket 70 defined by dilution member 48 and an annular sidewall 72 extending outwardly therefrom toward outer portion 46.

As further shown in FIG. 3, outer portion 44 of valve insert 40 includes a cover plate 74 that has a flange 76 and a handle opening 78. Flange 76 may be configured to engage sidewall 35 of housing 30, wherein such engagement may include mating engagement. Handle opening 78 is defined by an opening wall 80 which is part of a handle retaining projection 82. Handle retaining projection 82 also includes an outer wall 84 that is a tubular wall that projects inward from cover plate 74 and is located outward of the handle opening wall 80. Outer wall 84 and opening wall 80 may be concentric. Outer wall 84 and opening wall 80 are connected by bearing member 86 that is positioned inwardly from cover plate 74.

FIG. 3 also shows the present chemical dispensing device 10 and selector valve insert 40 includes a handle assembly 88 that comprises a shaft 90 having an outer surface 92, a first end 94, and a second end 96. Shaft 90 has an engagement portion 98 proximate first end 94, a mid-portion 100, and a handle knob connection portion 102 proximate second end 94. Shaft 90 includes an annular retaining ring 104 extending radially from outer surface 92 of shaft 90. The retaining ring 104 may correspond to the transition between engagement portion 98 and mid portion 100. Annular retaining ring 104 includes an annular rim 106 that extends perpendicular to the retaining ring 104. Annular rim 106, retaining ring 104 and outer surface 92 of shaft 90 forms a spring socket 108 configured to retain a spring 110 disposed between retaining ring 104 and center plate 58 of outer plate 46 of inner portion 42.

Shaft 90 of handle assembly 88 includes a key 112 proximate handle connection portion 102 that is configured to receive and engage a handle knob 114 (shown in FIGS. 1 and 2). As shown in FIG. 1, cover plate 74 may include a plurality of indicia 118 located thereon. Indicia 118 may include labels of the dilution ration obtained when handle knob 114 is turned to match indicia 118.

As shown in FIG. 3, when flow selector valve 14 is assembled, inner portion 42 of valve insert 40 is inserted into fluid chamber 31 such that seal 68 engages sidewall 35 of housing 30. Spring 110 is inserted around sidewall 72 of handle socket 70 to bear against center plate 58. First end 94 and engagement portion 98 of shaft 90 is inserted through spring 110 and into handle socket 70 such that the other end of spring 110 nests within spring socket 108 of shaft 90. Cover plate 74 of outer portion 46 of valve insert 40 slides over shaft 90, wherein handle connection portion 102 and mid portion 100 slides through handle opening 78. Annular retaining ring 104 bears against bearing member 86 of handle retaining protrusion 82. Cover plate 74 of outer portion 46 of valve insert 40 may be coupled to valve housing 30 with one or more fasteners 120. Handle knob 114 is then secured to shaft 90. When assembled, handle knob 114 and shaft 90 are capable to rotate relative to cover plate 74 and valve housing 30 to effectuate a rotation of inner portion 42 about center 57 of dilution member 48.

Figure 5:
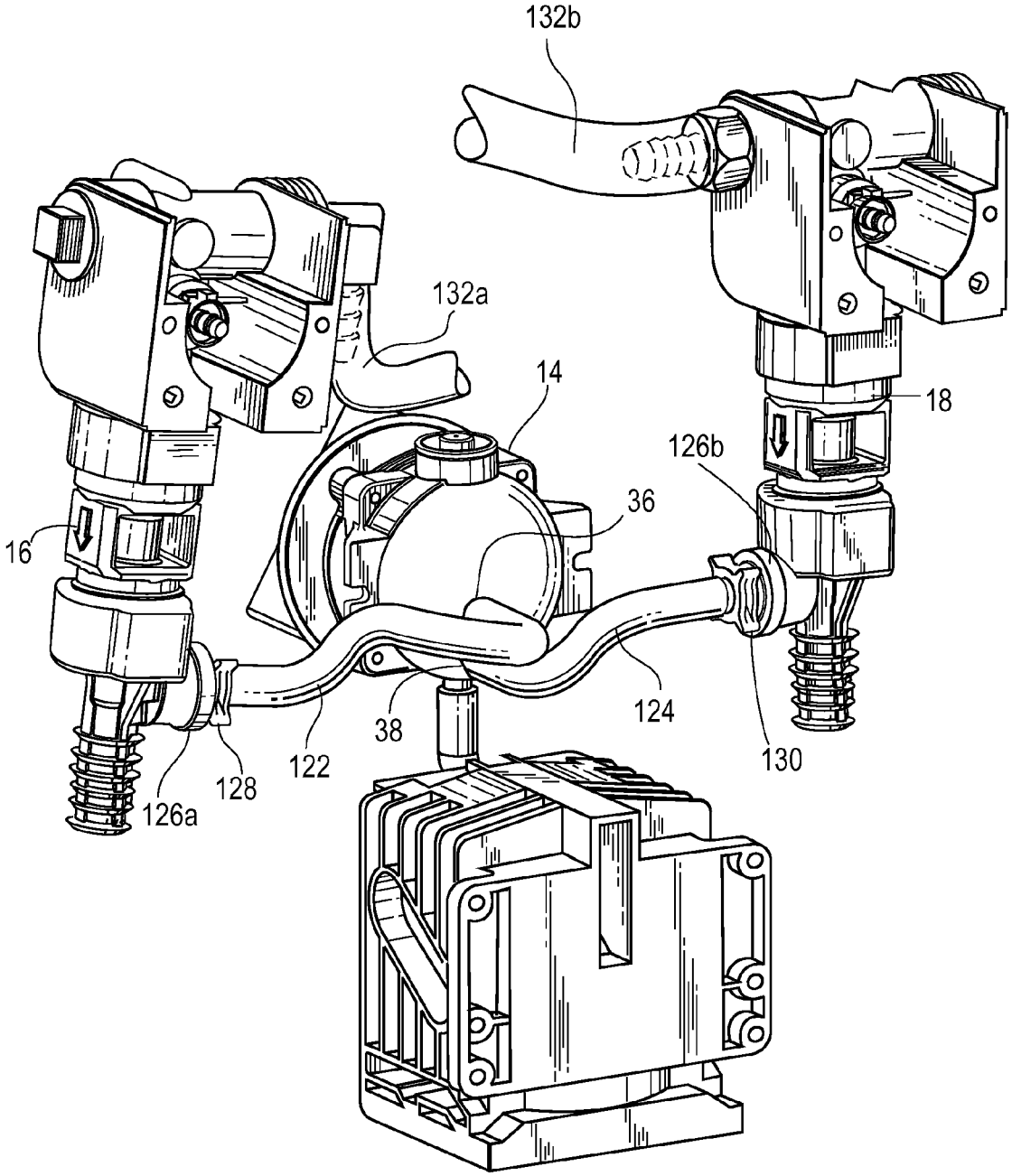
FIG. 5 is a rear perspective view of the embodiment the chemical dispensing device of FIG. 2.

Now turning to FIG. 5, chemical dispensing device includes a first proportioner supply tube 122 and a second proportioner supply tube 124. First proportioner supply tube 122 provides a fluid passageway from first chemical outlet port 36 to proportioner inlet port **126*a* of first proportioner 16. Second proportioner supply tube 124 provides a fluid passageway from second chemical outlet port 38 to proportioner inlet port 126*b* of second proportioner 18. First proportioner supply tube 122 includes a second check valve 128 disposed thereon. Second proportioner supply tube 124 includes a third check valve 130 disposed thereon. Second and third check valves 128 and 130 are disposed on proportioner supply tubes 122 and 124 and are biased closed in a direction of fluid flow through the supply tubes 122 and 124 respectively. Second and third check valves 128 and 130 are operable to open the passageway between the proportioner 16 or 18 and the flow selector valve 14 when there is suction acting in the supply tubes in a direction opposite of the direction of the fluid flow through the respective tube, for example, when the supply of motive fluid for one proportioner 18 or 16** is turned on and effectuates a partial vacuum on the system as the other proportioner is dispensing a water/chemical mixture.

Figure 6:
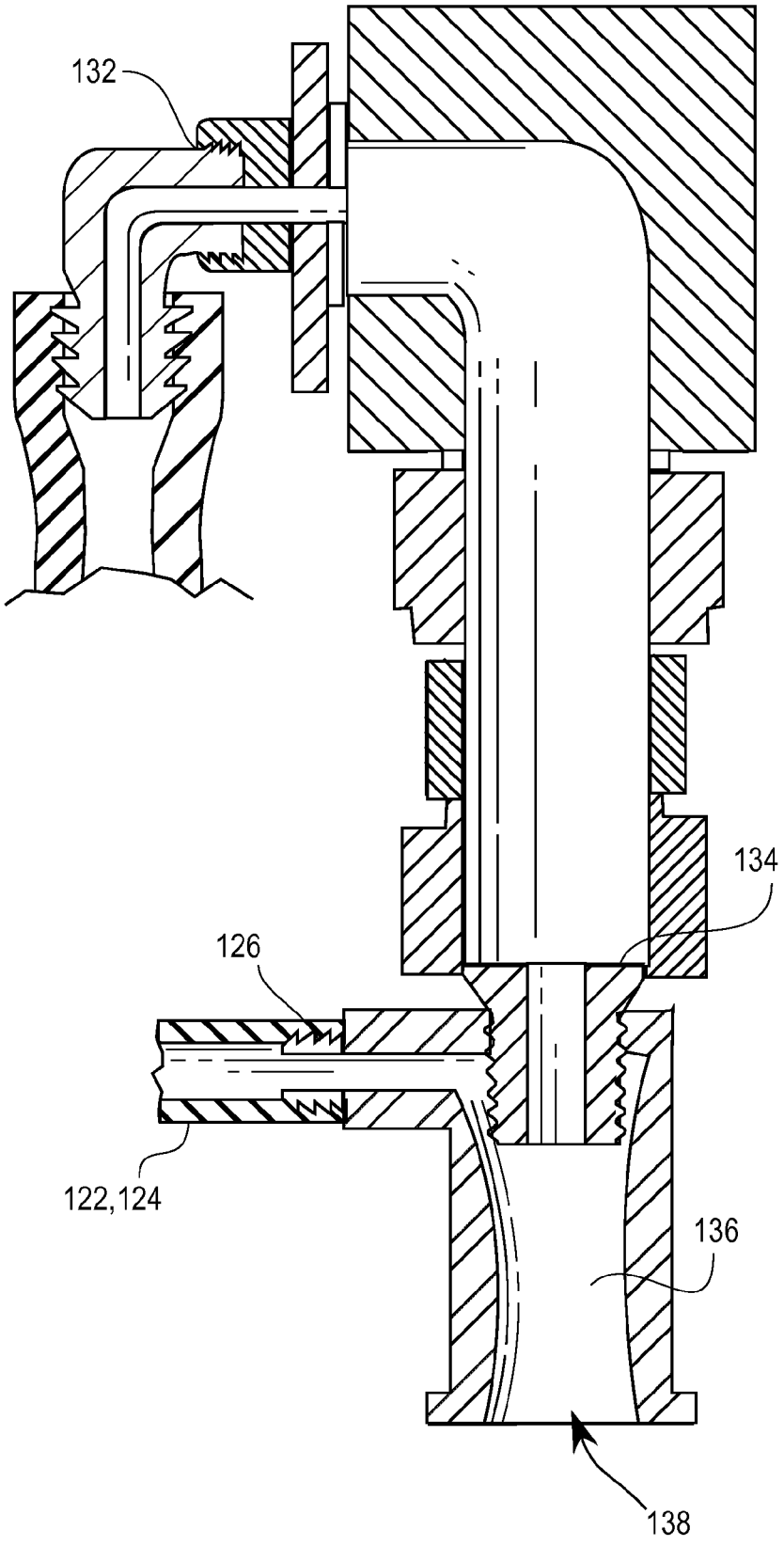
FIG. 6 a cross-sectional view of a proportioner of the embodiment the chemical dispensing device of FIG. 2 along the line 6-6.

As shown in FIG. 6, a cross-section of proportioner 16, 18 shows a proportioner known in the art wherein proportioner 16, 18 includes water inlet port 132. Proportioner 16, 18 may each include a constrictor insert 134 which is in fluid communication with water inlet port 132 and narrows the flow channel to restrict the flow of water through the proportioner. The proportioners 16, 18 may also include a mixing chamber 136 downstream and in fluid communication with both constrictor insert 134 and proportioner chemical inlet port 126. Water flowing through the mixing chamber 136 creates a suction (vacuum) force to pull a flow of chemical concentrate into proportioner 16, 18. The water and chemical concentrate mixes in the mixing chamber 136 and the mixture is discharged out of discharge outlet 138 into a desired container.

In use, bulk containers 24 have a volume of concentrated chemical preparations for any of a number of applications. Bulk containers 24 are placed into fluid communication with dock 22 (FIG. 2) or chemical selecting manifold 28 (FIG. 1) either directly or with supply tubes 26. Dock 22 or manifold 28 provide the user the ability to select from which bulk container the chemical concentrate is to be drawn.

A user will then rotatably adjust the position of handle knob 114 to a dilution position which aligns with the desired indicia 118. Indicia 118 may correspond to a designated dilution ratio. The embodiment shown includes a manual knob 114 that effectuates a rotation of inner portion 42 of valve insert 40 within the fluid chamber 31 of flow selector valve housing 30. In addition, one embodiment of the present chemical dispensing device 10 may have a handle knob 114 position and corresponding indicia 118 that allows a user to disperse water only.

As handle knob 114 is rotated, engagement portion 98 of handle shaft 90 engages handle socket 70 in inner portion 42 of valve insert 40 thereby causing a rotation of inner portion 42 of valve insert 40 with respect to housing 30. When handle knob 114 is set at a dilution position and aligned with an indicia 118, a corresponding radially aligned orifice pair comprising one first orifice 54 and one second orifice 56 is positioned in fluid communication with first concentrate outflow port 36 and second concentrate outflow port 38, respectively, as shown in FIG. 3. The size of first orifice 54 will provide the desired dilution ratio corresponding to indicia 118 upon being mixed with the first water supply rate provided to first proportioner 16, and the size of second orifice 56 provides the desired dilution ratio corresponding to indicia 118 upon being mixed with the second water supply rate provided to second proportioner 18. In one embodiment, the water supply to the first proportioner 16 is at a low water flow rate and the water supply to the second proportioner 18 is at a high water flow rate.

In one embodiment, the handle knob 114 may be put in a "water only" dilution position which is identified by corresponding indicia 118. At the "water only" dilution position, no holes are present in the dilution member 48 of the valve insert 40. Therefore, no chemical concentrate passes through the selector valve insert 40 into either of the proportioners 16, 18. Alternative to the manual handle system described herein, a person of skill in the art would recognize that an automatic control system utilizing a servo motor or similar device and user input interface could be used to rotate the selector valve insert within housing 30 to the user desired position.

Once the user has selected bulk container 24 from which the chemical concentrate is to be dispersed and adjusted the handle knob 114 to the indicia 118 corresponding the desired dilution ratio, the user will then turn on the water supply to one of the first proportioner 16 or the second proportioner 18. For example, the user turns on the water supply to the first proportioner 16 wherein the flow of motive fluid through the first proportioner 16 creates a suction force that begins to draw the chemical concentrate from bulk container 24, through flow selector valve 14 into the first concentrate outflow port 36. The suction force is sufficient to close first check valve 52 in the flow selector valve 14. Closing third check valve 130 prevents air from entering the system through the proportioner 18 and/or other fluid flow into flow selector valve 14 from second concentrate supply tube 124 to contaminate the diluted water/chemical concentrate mixture.

Upon the introduction of the suction force, the chemical concentrate is drawn from bulk container 24, through dock 22 or manifold 28, and through concentrate supply tube 34 and into flow selector valve 14 through chemical inlet port 32 into flow chamber 50. The chemical concentrate is then drawn through the user selected first orifice 54, and through first chemical out flow port 36 into first proportioner supply tube 122. The chemical concentrate is then drawn into first proportioner 16 through chemical inlet port **126*a* and passing through open second check valve 128. The chemical concentrate is then further drawn into mixing chamber 136 of first proportioner 16, mixed with the water, and the mixture is discharged through discharge outlet 138 of proportioner 16**.

The water supply may be continued until the container to be filled is full or filled to any other desired volume. Once the water supply to first proportioner 16 is turned off, the suction force ceases. At such time, the first check 52 valve returns to the open position to which it is biased. This allows the chemical to drain out of the system by gravity and back into a bulk container 24 from which it is stored. Using the present chemical dispersing device 10, a user can perform the steps above to draw chemicals from one of a plurality of bulk containers 24, at a user-selected dilution rate, and at a high or low water flow rate.

As is evident from the foregoing description, certain aspects of the present invention are not limited to the particular details of the examples illustrated herein. It is therefore contemplated that other modifications and applications using other similar or related features or techniques will occur to those skilled in the art. It is accordingly intended that all such modifications, variations, and other uses and applications which do not depart from the spirit and scope of the present invention are deemed to be covered by the present invention.

Other aspects, objects, and advantages of the present invention can be obtained from a study of the drawings, the disclosures, and the appended claims.

What is claimed is:

1. A multi-chemical dispensing device comprising:

a flow selector valve comprising a concentrate intake port, a first concentrate outflow port and a second concentrate outflow port, said flow selector valve further comprising a valve housing and a valve insert movably mounted within said valve housing, said valve insert including a flow chamber defined partially by a dilution member, said flow chamber being in fluid communication with said concentrate intake port, and wherein said dilution member comprises one or more first orifices and one or more second orifices in fluid communication with said flow chamber wherein each of said first orifice and said second orifice have an opening area that allows a fluid flow therethrough;

a first proportioner for discharging a mixture of concentrate and water at a first dilution ratio, said first proportioner in fluid communication with said first concentrate outflow port and in fluid communication with a first motive fluid supply wherein motive fluid is provided at a known first flow rate; and a second proportioner for discharging a mixture of concentrate and water at a second dilution ratio, said second proportioner in fluid communication with said second concentrate outflow port and in fluid communication with a second motive fluid supply wherein motive fluid is provided at a known second flow rate;

wherein said valve insert is movable to one or more dilution positions wherein at each dilution position one of said first orifices aligns with said first concentrate outflow port or one of said second orifices align with said second outflow port to allow fluid flow from flow chamber into at least one of said outflow ports for supplying a flow of concentrate to one of said first or second proportioners.

2. The multi-chemical dispensing device of claim 1 further comprising a concentrate supply dock, wherein one or more bulk containers are docked and in fluid communication with said dock and said dock is in fluid communication with said concentrate intake port.

3. The multi-chemical dispensing device of claim 1 further comprising a first check valve in fluid communication with said flow chamber, a second check valve operably disposed between said flow selector valve and said first proportioner, and a third check valve operably disposed between said flow selector valve and said second proportioner.

4. The multi-chemical dispensing device of claim 3 wherein said first check valve is biased in an open position and operable to close upon a suction introduced into the concentrate dispensing device by flow of motive fluid from one of said first or second motive fluid supply through its corresponding proportioner.

5. The multi-chemical dispensing device of claim 4 wherein said second check valve is biased closed in a first direction opposite of fluid flow from said flow selector valve to said first proportioner and said second check valve is operable to open upon a suction force applied in the direction of said first direction of fluid flow, and said third check valve is biased closed in a second direction opposite of fluid flow from said flow selector valve to said second proportioner and said third check valve is operable to open upon a suction force in the direction of said second direction of fluid flow.

6. The multi-chemical dispensing device of claim 5 wherein said second and said third check valves prevent air from entering the flow selector valve when said valves are in a closed position.

7. The multi-chemical dispensing device of claim 1 wherein the dilution member includes two or more orifice pairs, each of said orifice pairs comprising one of said first orifices and one of said second orifices, and wherein each of said dilution positions includes an orifice pair wherein at each alignment position, said first orifice of said orifice pair aligns with said first concentrate outflow port and said second orifice of said orifice pair aligns with said second concentrate outflow port.

8. The multi-chemical dispensing device of claim 7 wherein said first and second orifices in each of said two or more orifice pairs are radially aligned relative to a member center.

9. The multi-chemical dispensing device of claim 1 wherein said first flow rate is less than said second flow rate and said first dilution ratio is substantially equal to said second dilution ratio.

10. The multi-chemical dispensing device of claim 1, wherein said first flow rate and said second flow rate are equal and said first dilution ratio is substantially different than said second dilution rate.

11. The multi-chemical dispensing device of claim 7 further comprising a handle knob operably connected to said dilution member wherein actuating said handle knob effectuates movement of said dilution member, said handle knob being movable between at least two of said dilution positions.

12. The multi-chemical dispensing device of claim 7 further comprising said valve insert being movable to a motive fluid-only position wherein said dilution member includes no orifices at said motive fluid-only position.

13. The multi-chemical dispensing device of claim 7 further comprising a detent operable to releasable engage said valve insert to accurately position said dilution member at one of said dilution positions.

14. The multi-chemical dispensing device of claim 1 further comprising a concentrate supply tube in fluid communication with said concentrate intake port and two or more bulk containers, each bulk container containing a liquid concentrate.

15. A multi-chemical dispensing device comprising:

a concentrate supply tube;

a flow selector valve having a housing and a valve insert, said housing comprising a concentrate intake port, a first concentrate outflow port, and a second concentrate outflow port, said concentrate intake port in fluid communication with said concentrate supply tube, said valve insert including a flow chamber defined partially by a dilution member and in fluid communication with said concentrate intake port, said dilution member including two or more orifice pairs, each of said orifice pairs comprising one first orifice and one second orifice, said first and said second orifice in each orifice pair being aligned relative to a dilution member center, wherein in each said orifice pairs, said first orifice has an inner opening area allowing a fluid flow therethrough and said second orifice has an outer opening area allowing a fluid flow therethrough;

a first proportioner in fluid communication with said first concentrate outflow port and in fluid communication with a first motive fluid supply wherein motive fluid is provided at a known first flow rate to discharge a concentrate mixture at a first dilution ratio;

a second proportioner in fluid communication with said second concentrate outflow port and in fluid communication with a second motive fluid supply wherein motive fluid is provided at a known second flow rate to discharge a concentrate mixture at a second dilution ratio;

a first check valve in fluid communication with said flow chamber, said first check valve being biased in an open position and operable to close upon a suction force acting within said flow selector valve;

a second check valve operably disposed between said flow selector valve and said first proportioner, said second check valve is biased closed in a first direction opposite of fluid flow from said flow selector valve to said first proportioner, wherein said second check valve is operable to open upon a suction force applied in the direction of said first direction of fluid flow; and a third check valve operably disposed between said flow selector valve and said second proportioner, said third check valve is biased closed in a second direction opposite of fluid flow from said flow selector valve to said second proportioner, wherein said third check valve is operable to open upon a suction force in the direction of said second direction of fluid flow.

16. The multi-chemical dispensing device of claim 15 wherein said second and said third check valves prevent air from entering the flow selector valve when said valves are in a closed position.

17. The multi-chemical dispensing device of claim 15 wherein in each orifice pair, said inner opening area is less than said outer opening area, and said first dilution ratio is substantially equal to said second dilution ratio.

18. A multi-chemical dispensing device comprising:

a flow selector valve comprising a concentrate intake port, a first concentrate outflow port and a second concentrate outflow port, said flow selector valve further comprising a valve housing and a valve insert movably mounted within said valve housing, said valve insert including a flow chamber defined partially by a dilution member, said flow chamber being in fluid communication with said concentrate intake port, and wherein said dilution member comprises one or more first orifices and one or more second orifices in fluid communication with said flow chamber wherein each of said first orifice and said second orifice have an opening area that allows a fluid flow therethrough;

a first proportioner for discharging a mixture of concentrate and water at a first dilution ratio, said first proportioner in fluid communication with said first concentrate outflow port and in fluid communication with a first motive fluid supply wherein motive fluid is provided at a known first flow rate;

a second proportioner for discharging a mixture of concentrate and water at a second dilution ratio, said second proportioner in fluid communication with said second concentrate outflow port and in fluid communication with a second motive fluid supply wherein motive fluid is provided at a known second flow rate; and wherein said valve insert is movable to one or more dilution positions wherein at each dilution position one of said first orifices aligns with said first concentrate outflow port or one of said second orifices align with said second outflow port to allow fluid flow from flow chamber into at least one of said outflow ports.

* * * * *